United States Patent [19]

Brown

[11] 3,946,791

[45] Mar. 30, 1976

[54] REVERSIBLE ONE WAY DRAW CURTAIN ROD

[76] Inventor: David L. Brown, 3312 W. 14th Ave., Eugene, Oreg. 97402

[22] Filed: Sept. 20, 1974

[21] Appl. No.: 507,815

[52] U.S. Cl. ..... 160/345; 16/87.4 R

[51] Int. Cl.[2] ..... A47H 5/032

[58] Field of Search ..... 160/126, 330, 345–348; 16/87.4, 87.6

[56] References Cited

UNITED STATES PATENTS

| | | | |
|---|---|---|---|
| 1,916,719 | 7/1933 | Dover et al. | 160/345 |
| 2,051,342 | 8/1936 | Nudelman et al. | 160/126 |
| 2,486,224 | 10/1949 | Stutz | 160/345 |
| 3,665,550 | 5/1972 | MacFarlane et al. | 160/345 |

*Primary Examiner*—Philip C. Kannan
*Attorney, Agent, or Firm*—James D. Givnan, Jr.

[57] ABSTRACT

A one way draw curtain rod assembly providing either a left or right hand draw cord location. A pulley assembly on the curtain rod is invertible into either of two positions to enable the relocation of the draw cords with respect to the curtain on the rod. Triangularly disposed pulleys serve to rotatably support the draw cords with the pulley-cord relationship being changed upon curtain rod inversion so as to function in a like manner in either position. The pulley assembly is affixed to the larger telescopic rod member to partake of the added strength of said member. A master carrier includes a detachable component removable upon curtain rod inversion and reattachable to locate a curtain bar to receive the outer segment of the curtain.

3 Claims, 5 Drawing Figures

REVERSIBLE ONE WAY DRAW CURTAIN ROD

BACKGROUND OF THE INVENTION

The present invention relates to curtain rod structures and more particularly to a one way draw curtain rod equally adaptable to locating the draw at either end.

Conventional one way curtain rod construction includes curtain rods having a pulley assembly mounted at one or the other end of the rod in a fixed manner to locate the draw cords as desired, either a right or a left hand draw. Additionally, within the curtain rod field are one way rod assemblies where the pulley assembly is mounted to both ends of the rod such being termed a convertible one way draw.

An objectional feature found in right or left hand one way draw curtain rod assemblies is that they may not be altered should the homeowner desire to alter the location of the draw cords, therefore changing the direction in which the curtains will pull. The problem is somewhat alleviated by the above mentioned convertible one way draw. Said convertible one way draw curtain rods require the retailer or homeowner to pull the cords through the rod, change the master slide arm, and change the curtain slides to the opposite end to provide the left or right hand pull desired. This is, in effect, a two way rod converted into a one way rod. An objection to such an arrangement is that it results in the pulley assembly and associated brackets supporting same being associated in some instances with the weaker or smaller of the telescopic curtain rods. After a lengthy period of use, forces imparted to the pulley assembly, which is partially supported by the smaller telescopic member, result in adverse wear and early failure of the rod and/or other components.

SUMMARY OF THE INVENTION

The present curtain rod is directed toward providing a durable one way draw curtain rod adaptable for use as either a right hand or left hand pull such being accomplished simply upon inverting and turning of the rod end-for-end without removal and reinstallation of the pulley assembly being required.

Telescopic rod members of the present rod are substantially conventional in that they are slotted throughout their lengths to receive slides for reception of curtain hooks. Secured to the larger or primary telescopic rod is a pulley assembly having multiple pulleys about some of which are routed the curtain draw cords. The unique pulley arrangement permits the pulley assembly to function when inverted such inverting permitting selective locating of the cord pull at either side of a window. A master carrier assembly includes a detachable component which may be repositioned upon rod inversion. A hinged component of the master carrier is also repositionable upon inversion of the traverse rod.

Objectives of the present reversible curtain rod assembly include: the provision of a rod having a pulley assembly secured in a permanent manner to one end of the curtain rod, said assembly being operable in an inverted position to enable the curtain rod to be turned end-for-end and inverted to provide left or right hand draw cords as desired without rod or pulley disassembly and without cord removal and reinstallation; the provision of a curtain rod having a pulley assembly permanently associated with the main telescopic rod member thereby avoiding the undesirable consequences of combining a pulley assembly with a secondary (smaller sized) telescopic rod member resulting in undue loads being imparted to the last mentioned member; the provision of a curtain rod including a master carrier including a detachable curtain bar component for removal and reinstallation on the master carrier slide without the use of tools to support the outer edge of the curtain in a normal manner; the provision of a reversible curtain rod having components arranged so as to operate with equal ease and in a trouble free manner regardless of the rods installed position; the provision of a curtain rod equally adaptable to locating the cord draw at either of its ends thereby obviating large curtain rod inventories and installation problems encountered by those in the trade.

DETAILED DESCRIPTION OF THE PREFERRED EMBODIMENT

Figures 1, 2, 3, 4, 5:
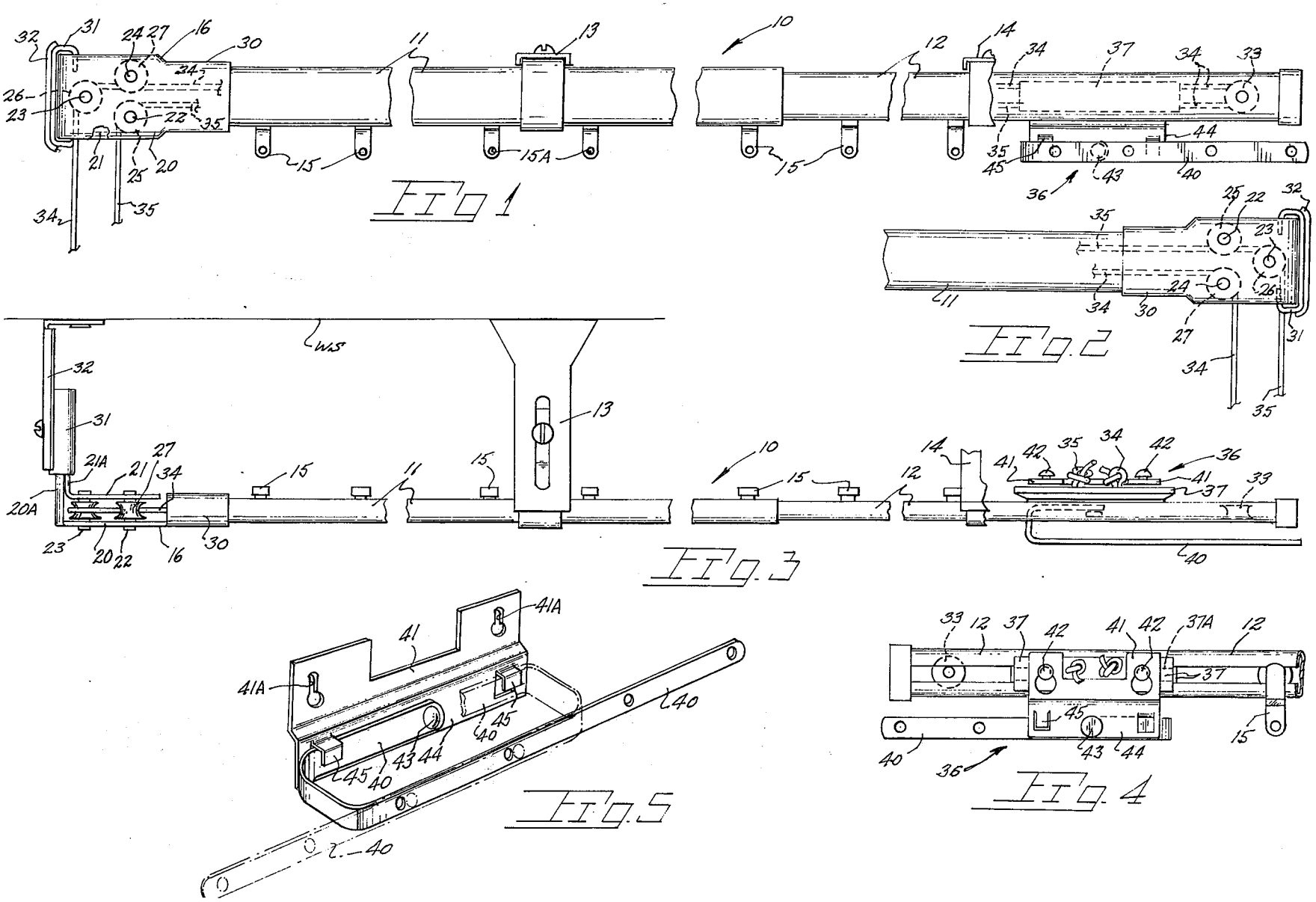
FIG. 1 is a front elevational view of the reversible draw curtain rod embodying the present invention.
FIG. 2 is a fragmentary front elevational view of the curtain rod of FIG. 1 relocated by turning end-for-end and inverting same to reposition the draw cords at the right hand side of a curtain.
FIG. 3 is a plan view of FIG. 1.
FIG. 4 is an elevational view of the unseen side of the curtain rod end and master carrier assembly viewed in FIG. 1.
FIG. 5 is a perspective view of the master carrier assembly.

With continuing reference to the accompanying drawing wherein applied reference numerals indicate parts similarly identified in the following specification, the reference numeral 10 indicates generally the present curtain rod assembly including a primary rod member 11 and secondary or lesser sized rod member 12 in telescopic engagement in the well-known manner. Supporting the rod members 11 and 12 are adjustable brackets 13 and 14 which may be of conventional style as are the slides at 15 carried by each of the rod members and apertured at 15A to receive inserted curtain supporting hooks (not shown).

Integral with primary rod member 11 is a pulley assembly 16 including angular pulley mounting plates 20 and 21 which serve to mount pulley spindles 22, 23 and 24 on which are journalled pulleys 25, 26 and 27. Pulley mounting plate 20 terminates outwardly in a reduced sleeve 30 within which is permanently affixed one end of primary rod 11. Pulley plates 20 and 21 are both of an angular nature having segments at 20A and 21A extending generally parallel into wedged engagement with a holder 31 comprising part of a conventional bracket 32 in place on a wall surface WS.

As aforesaid the two telescopic rod members 11 and 12 are of conventional design with the interfitted end of member 12 extensible from member 11 to provide adjustment for the length desired in a particular installation. The distal end of rod member 12 carries a pulley 33 about which is entrained a curtain draw cord at 34 while a similar draw cord is indicated at 35.

A master carrier indicated generally at 36 includes a slide member 37 for travel internally within rod members 11 and 12 in response to oppositely exerted forces imparted thereto by the draw cords 34 and 35 terminating in opposite attachment to slide member 37 having cord receiving openings therein. Slide member 37 is bifurcated at 37A lengthwise to provide slotted areas therealong which receive the opposing edges of each cutain rod member 11 and 12. Accordingly, member 37 is entrained for rectilinear movement along members 11 and 12 during opening and closing of a curtain supported from slides 15 and a later described curtain bar.

With reference to FIGS. 3 and 4, it will be seen that master carrier assembly 36 includes a detachable curtain bar 40 and bar carrier plate 41 the latter having keyhole shaped openings 41A formed therein for detachable engagement with studs 42 each having an enlarged head portion for retention of bar carrier plate 41. The enlarged open areas 41A permit detachment of plate 41 upon lifting and separating motions of plate 41 relative to slide 37. As best viewed in FIG. 5, plate 41 is of irregular shape having an offset lower portion 44 which pivotally mounts at 43 curtain support bar 40 of U-shape. Ears at 45 are struck from offset lower portion 44 and serve as limit stops when relocating bar 40 about pivot 43. Changing of the present curtain rod from a right hand pull to a left hand pull or vice versa necessitates removal of plate 41 from slide 37 with reattachment adjacent the opposite edge of the curtain rod which, of course, has been inverted. The offset medial portion of component 41 is always directed toward the front side of the curtain rod so as to position curtain bar 40 substantially in alignment with slides 15 to receive curtain hooks associated with the outer end of the curtain.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A reversible one way draw curtain rod assembly enabling the draw cords to be located at either side of a curtained window upon relocation of a wall mounted bracket and rod holder without curtain rod disassembly, said curtain rod assembly comprising, a one way curtain rod with curtain supporting slides, said rod supported at one of its ends by a holder and at points therealong, a pulley assembly affixed to the supported end of the curtain rod and projecting outwardly therefrom, said pulley assembly including three pulley members, at least two pulley members at all times supporting a pair of entrained draw cords, the remaining pulley member serving to receive one of the cords upon the rod being turned end-for-end in an upright path during reversing the curtain rod, and a master carrier assembly comprising, a slide member slidably disposed within said curtain rod for travel lengthwise of the curtain rod in response to curtain cord movement, a carrier plate, a curtain bar pivotally attached to said carrier plate, means detachably supporting said carrier plate on said slide member permitting removal of said carrier plate from the slide member and subsequent reinstallation thereon upon inversion of the curtain rod so as to relocate said curtain bar in substantial alignment with the curtain slides on the rod.

2. The reversible one way draw curtain rod assembly as claimed in claim 1 wherein said pulley assembly includes pulley mounting plates oppositely spaced from said pulley members, said pulleys carried by spindles secured at their ends to said mounting plates.

3. The reversible one way draw curtain rod assembly as claimed in claim 1 wherein said detachable mounting means includes slide mounted studs engageable with keyhole shaped openings formed in the curtain bar carrier plate whereby removal and reattachment of the carrier plate to said slide may be accomplished manually without the aid of tools.

* * * * *